United States Patent [19]

Uchida

[11] 4,099,667

[45] Jul. 11, 1978

[54] APPARATUS FOR PREVENTING VIBRATION IN A CENTRIFUGAL SEPARATOR

[75] Inventor: Tadahiro Uchida, Sayama, Japan

[73] Assignee: Kabushiki Kaisha Kubota Seisakusho, Tokyo, Japan

[21] Appl. No.: 769,718

[22] Filed: Feb. 17, 1977

[30] Foreign Application Priority Data

Jul. 9, 1976 [JP] Japan ..... 51-90450

[51] Int. Cl.[2] ..... B04B 9/02

[52] U.S. Cl. ..... 233/24; 233/1 C; 210/144; 200/233; 318/460

[58] Field of Search ..... 233/1 R, DIG. 1, 1 B, 233/23, 24, 1 C; 68/23.1, 23.3; 210/144; 318/460, 275; 200/233, 226, 227

[56] References Cited

U.S. PATENT DOCUMENTS

| | | | |
|---|---|---|---|
| 1,688,217 | 10/1928 | Whalen | 200/233 |
| 1,803,986 | 5/1931 | Walker | 200/233 |
| 2,699,289 | 1/1955 | Allen et al. | 233/26 |
| 3,195,034 | 7/1965 | Bensema | 318/460 |
| 3,268,791 | 8/1966 | Burns et al. | 318/460 |
| 3,298,525 | 1/1967 | Houser | 210/144 |

*Primary Examiner*—George H. Krizmanich
*Attorney, Agent, or Firm*—Haseltine, Lake & Waters

[57] ABSTRACT

An apparatus for preventing vibration in a centrifugal separator comprising an upright electric motor supported by a resilient member from a machine casing and wherein excessive vibration of the motor is detected for opening an electric power circuit of the motor. A mercury type vibration sensitive element is employed in the detector and comprises a mercury contact in a metallic casing. The vibration sensitive element is attached to a resilient plate and is in pressure contact with a lateral surface of a casing of the motor.

9 Claims, 5 Drawing Figures

APPARATUS FOR PREVENTING VIBRATION IN A CENTRIFUGAL SEPARATOR

FIELD OF THE INVENTION

The invention relates to apparatus for preventing vibration in a centrifugal separator which exceeds the predetermined magnitude.

BACKGROUND

In a conventional centrifugal separator an unbalance in the weight of the sample placed in a rotor is detected by a suitable detecting means and the motor is automatically deactivated to halt the rotation of the rotor. It is conventional to employ a mercury type vibration sensitive element as the detecting means.

However, the mercury element in the detecting means has been subject to the rotation of the rotor which leads to unnecessary stoppage of the motor at high speed operation.

SUMMARY OF THE INVENTION

An object of the invention is to provide a detecting means in which the aforesaid disadvantage is overcome.

Another object of the invention is to provide a detecting means which is not subject to the rotation of the motor.

Yet, another object of the invention is to employ a detecting means which is operative throughout the entire range of rotational speeds of the rotor.

In accordance with the aforesaid objects there is provided an improvement in a centrifugal separator having an upright electric motor resiliently supported in a casing and adapted to drive a rotor in rotation, said improvement comprising vibration sensitive means coupled to the motor to control energization thereof and means supporting said vibration sensitive means in pressure contact with said motor such that if said motor undergoes excessive vibration, the vibration sensitive means deactivates the motor.

DETAILED DESCRIPTION

Figure 1:
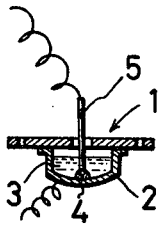
FIG. 1 is a sectional view of a mercury type vibration sensitive element.
Figure 1A:
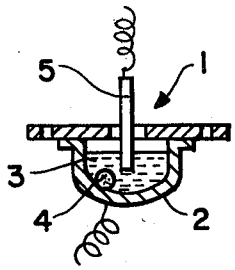
FIG. 1*a* is a sectional view similar to FIG. 1 showing the mercury type vibration sensitive element in open condition.

FIG. 1 shows a mercury type vibration sensitive element 1 comprising a hermetically sealed metallic container 2 containing an insulating liquid 3 and a pool of mercury 4. An electrode 5 is mounted in the container so as to be in contact with the mercury 4 so that an electric current may flow through the electrode 5 and the mercury 4 in the normal condition whereas the electric current is cut off if the mercury 4 becomes spaced from the electrode 5 due to vibration exceeding a predetermined level. The spaced relation of electrode 5 from mercury 4 is shown in FIG. 1*a*.

Figure 4:
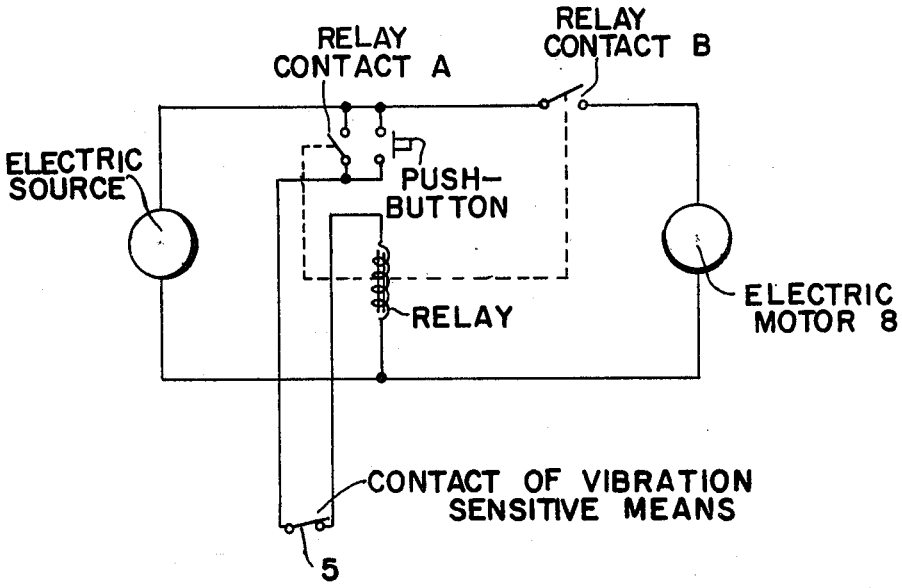
FIG. 4 is a circuit diagram of the connection of the vibration sensitive element in the power supply circuit of the motor.

Accordingly, element 1 can be attached directly to an electric motor of a centrifugal separator for preventing abnormal vibration of the motor. The electrode 5 and container 2 are connected in the electric power circuit of the motor to interrupt the same when the electrode 5 loses contact with the pool of mercury. A typical conventional circuit for the connection of the sensitive element 1 in the electrical power circuit is shown in FIG. 4. Therein when there is no vibration, the contact of the vibration sensitive means 1 is closed. If, under this condition, the push-button is pushed to closed position, the relay coil is energized and the two contacts A and B are closed. Thereafter even if the push-button is released, the relay coil is kept energized. By the closing of the contact B, the electric motor 8 is energized to operate. If the sensitive means 1 is opened, the relay contacts A, B are opened. Once they are opened, even if the vibration is removed, the relay coil is not operated, as long as the push-button is not pushed again, and accordingly the electric motor is stopped. However, if element 1 is subjected to a horizontal vibration, it operates with equal sensitivity to such vibration in any direction from 0 to 360 degrees, so that, the above arrangement is subjected to a deficiency in its operation as follows.

When the centrifugal separator is intended to be used under the condition that the amount of unbalance exceeds a predetermined level, it is necessary to stop the motor before it reaches a high speed of rotation. Namely, it is necessary to stop the motor at a low speed rotation of, for example, about 300 r.p.m. where the motor is designed to operate at a high speed rotation of, for example, 4000 r.p.m. Accordingly, the foregoing element 1 is required to have such sensitivity that it operates at such a low speed rotation when the amount of unbalance is beyond a predetermined level, whereas it will not operate at such a low speed rotation if the amount of unbalance is small. Even with this arrangement, however, there is brought about the disadvantage that, even with such a small amount of unbalance, the element 1 becomes operative at the time of high speed rotation which results in stopping the motor unnecessarily.

This is because the element 1 is normally subject to the rotation vector of the vibration produced by the electric motor so that even when the vibration amplitude produced by the amount of unbalance is constant, if the speed of rotation of the motor is increased, the mercury constituting the contact in the element 1 is moved circumferentially to open the circuit.

Figure 2:
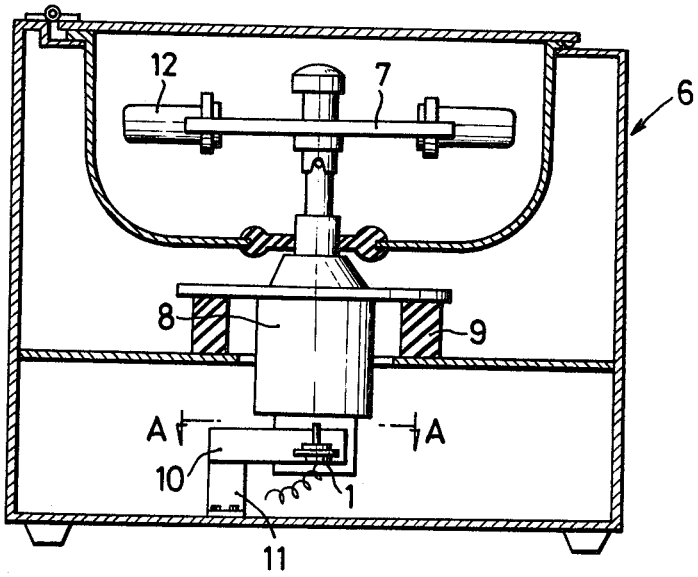
FIG. 2 is a front sectional view of an embodiment of a centrifugal separator employing the vibration sensitive element according to this invention.
Figure 3:
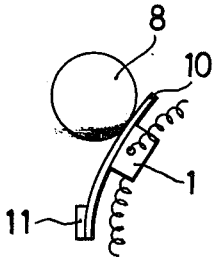
FIG. 3 is a view taken in the direction of arrows A—A in FIG. 2.

This invention seeks to overcome this disadvantage as will now be explained with reference to the embodiment as shown in FIG. 2.

Referring to this Figure, numeral 6 denotes a centrifugal separator for effecting operations of sedimentation, separation, dehydration or the like. The separator contains a rotor 7 driven by an electric motor 8 supported in an upright position through a vibration-proof member 9 within an outer casing of the separator 6. A resilient plate 10 made of rubber or the like is brought into pressure contact with a lower portion of a casing of the motor 8 at one side thereof, and the mercury type vibration sensitive element 1 is attached to the resilient plate 10. The resilient plate 10 is supported in the form of a swingable arm by a bracket 11 secured to the outer casing. Numeral 12 denotes a bucket for containing a sample to be driven in rotation by motor 8.

Thus, according to the invention, the mercury type vibration sensitive element 1 is attached to the resilient plate 10 which is in pressure contact with one side surface of the casing of the electric motor 8, and the resilient plate 10 is subject to vibration only in its most easily movable direction, i.e., a swinging direction. Consequently, it can be prevented that the resilient plate 10 becomes spaced apart from the motor 8 by a horizontal vibration of the motor 8 and thereby the vibration of the motor 8 can be transmitted without fail to the vibration sensitive element 1. Thus, the vibration of the motor when the amount of unbalance exceeds a predetermined level causes the mercury to move in the element 1 so as to stop the motor, whereas the rotating vector of the motor at the time of high speed rotation does not act on the element 1. Hence, the foregoing disadvantage can be prevented and the apparatus can be simple in construction and is stable and reliable in operation.

Although the invention has been described in relation to a specific embodiment thereof it will become apparent to those skilled in the art that numerous modifications and variations thereof can be made within the spirit and scope of the invention as defined in the appended claims.

What is claimed is:

1. In a centrifugal separator having an upright electric motor resiliently supported in a casing and adapted to drive a rotor in rotation, an improvement comprising vibration sensitive means coupled to the motor to control energization thereof, and means supporting said vibration sensitive means in pressure contact with said motor such that if said motor undergoes excessive vibration, said vibration sensitive means deactivates the motor, said means supporting said vibration sensitive means comprising a resilient arm carrying said vibration sensitive means, said motor comprising a casing, said arm being in lateral pressure contact with said casing to respond to radial vibration of the casing of the motor and thereby transmit only such radial vibration to said vibration sensitive means.

2. The improvement as claimed in claim 1 wherein said vibration sensitive means comprises a mercury type vibration sensitive element.

3. The improvement as claimed in claim 2 wherein said mercury type vibration sensitive element comprises a hermetically sealed casing, a pool of mercury in said casing, an insulating liquid on said mercury, and an electrode extending into said casing for normally contacting the pool of mercury.

4. The improvement as claimed in claim 3 wherein said motor is mounted for producing rotation about a vertical axis.

5. The improvement as claimed in claim 4 wherein said resilient arm carries said hermetically sealed casing.

6. The improvement as claimed in claim 5 wherein said resilient arm is made of rubber and is disposed horizontally.

7. The improvement as claimed in claim 6 wherein the supporting means further comprises a bracket secured in the separator and carrying said resilient arm in lateral pressure contact with said casing of the motor.

8. The improvement as claimed in claim 7 wherein the rotor is disposed on one side of the motor and the resilient arm on the other side of the motor.

9. The improvement as claimed in claim 8 wherein the rotor is above the resilient arm.

* * * * *